US007850153B2

(12) United States Patent
Bock

(10) Patent No.: US 7,850,153 B2
(45) Date of Patent: Dec. 14, 2010

(54) PAD SPRING DEVICE

(75) Inventor: Klaus Bock, Verl (DE)

(73) Assignee: Spiroplex GmbH (DE)

( * ) Notice: Subject to any disclaimer, the term of this patent is extended or adjusted under 35 U.S.C. 154(b) by 772 days.

(21) Appl. No.: 11/792,437

(22) PCT Filed: Feb. 21, 2006

(86) PCT No.: PCT/EP2006/001528

§ 371 (c)(1),
(2), (4) Date: Jun. 6, 2007

(87) PCT Pub. No.: WO2006/089705

PCT Pub. Date: Aug. 31, 2006

(65) Prior Publication Data

US 2008/0128965 A1 Jun. 5, 2008

(30) Foreign Application Priority Data

Feb. 22, 2005 (DE) ..... 20 2005 002 906 U
Dec. 17, 2005 (EP) ..... 05027702

(51) Int. Cl.
*F16F 1/04* (2006.01)

(52) U.S. Cl. ..... 267/103; 5/247

(58) Field of Classification Search ..... 5/247, 5/253, 655.8, 720; 267/80, 103
See application file for complete search history.

(56) References Cited

U.S. PATENT DOCUMENTS 614,987 A 11/1898 Ryan
1,893,170 A 1/1933 Hilton
3,122,360 A 2/1964 Terry et al.
3,462,779 A * 8/1969 Thompson ..... 5/655.8
3,633,228 A * 1/1972 Zysman ..... 267/152
3,869,739 A 3/1975 Klein
4,485,506 A * 12/1984 Stumpf et al. ..... 5/655.8
5,632,473 A * 5/1997 Dias Magalhaes Queiroz ..... 267/164
5,669,093 A * 9/1997 Ogle et al. ..... 5/720
5,699,998 A * 12/1997 Zysman ..... 267/189
5,761,784 A * 6/1998 Ogle et al. ..... 5/720

(Continued)

FOREIGN PATENT DOCUMENTS

BE 475315 9/1947

(Continued)

OTHER PUBLICATIONS

ISR dated Sep. 26, 2006 for PCT/EP2006/001528 (In English and German).

(Continued)

*Primary Examiner*—Christopher P Schwartz
(74) *Attorney, Agent, or Firm*—Harness, Dickey & Pierce, P.L.C.

(57) ABSTRACT

The invention relates to an upholstery spring device (1), especially for upholstery cushions, mattresses, or similar, comprising a plurality of upholstery spring elements (2). The aim of the invention is to create an upholstery spring device (1) which can be used with a great degree of flexibility while being simple and inexpensive to produce. Said aim is achieved by an upholstery spring device (1) comprising a plurality of adjacent upholstery spring elements (2) which are joined to each other by means of a flexible connecting device (5, 120) so as to form a joint unit.

15 Claims, 9 Drawing Sheets

U.S. PATENT DOCUMENTS

| | | | | |
|---|---|---|---|---|
| 6,243,900 | B1 * | 6/2001 | Gladney et al. | 5/720 |
| 2005/0235416 | A1 * | 10/2005 | Jansen | 5/236.1 |

FOREIGN PATENT DOCUMENTS

| | | | |
|---|---|---|---|
| DE | 40 00 870 | A1 | 7/1991 |
| DE | 20 2004 010 143 | U1 | 9/2004 |
| EP | 0 629 369 | A1 | 12/1994 |
| EP | 1 127 520 | A1 | 8/2001 |
| EP | 1 680 987 | A1 | 7/2006 |
| GB | 104787 | | 5/1916 |
| GB | 202802 | | 8/1922 |
| JP | 11-56534 | | 3/1999 |
| WO | WO 2004/034841 | A2 | 4/2004 |
| WO | WO 2004/086915 | A1 | 10/2004 |
| WO | WO 2005/084495 | A1 | 9/2005 |

OTHER PUBLICATIONS

Written Opinion of the International Searching Authority for PCT/EP2006/001528 (In German).

* cited by examiner

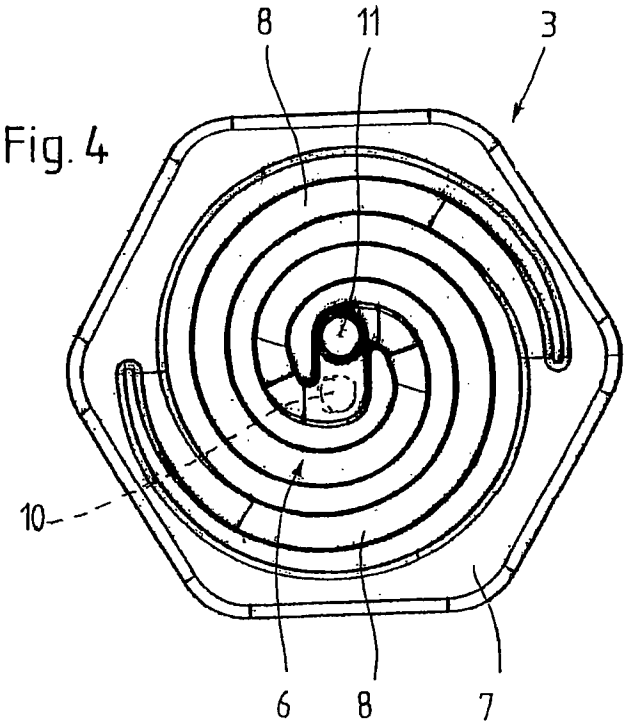
Fig. 4
Fig. 2
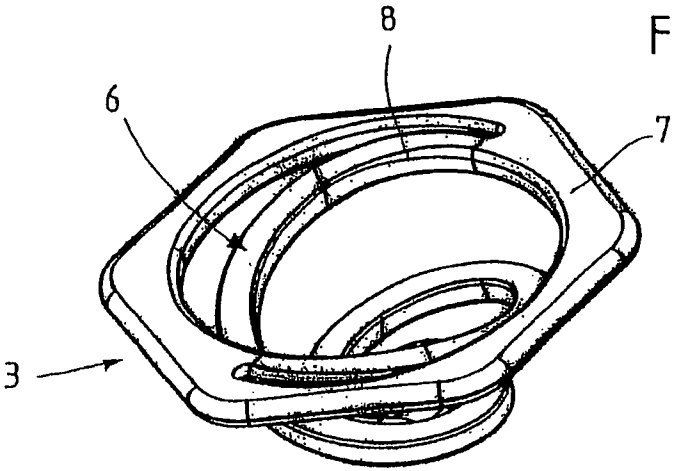
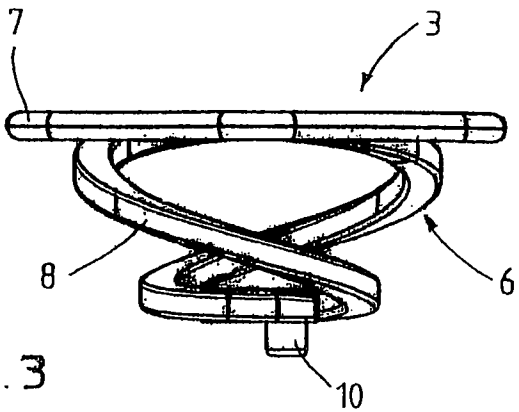
Fig. 3

PAD SPRING DEVICE

The invention relates to a pad spring device, in particular for upholstered cushions, mattresses or the like, comprising a plurality of pad spring elements as well as to a pad element comprising such a pad spring device.

A pad spring device of the above mentioned type is known from the International Patent Application WO 2004/086915 A1. The pad spring device comprises a plurality of pad spring elements with respectively one upper and one lower supporting plate as well as an interposed spring element. The supporting plates of these pad spring elements are frame- or ring-shaped and have spring arms formed thereon which extend radially inwards and like funnels towards a common centre. The thus formed pad spring elements can be surrounded by a shell construction, for example made of foamed material, for forming a mattress. This shell construction encompasses both the spring arms and the centre of each pad spring element. Thus, a separate receiving area has to be formed in the foamed material of the mattress for each pad spring element.

The above described pad spring elements that are known from WO 2004/086915 present different drawbacks. Thus, a certain overall height of the pad spring elements is required due to the spring arms that extend radially inwards, in order to achieve the desired resilience comfort. Therefore, the pad spring elements known from WO 2004/086915 A1 are not suitable for equipping a pad element that is relatively thin in the height direction, such as for example a seat-cushion, an upholstered cushion for chairs or the like.

Furthermore, it is a drawback that for forming a mattress, the pad spring elements according to WO 2004/086915 A1 have to be placed in receivers that have to be separately formed for each pad spring element in the foamed material of the mattress, as it is the case of pocket spring mattresses. Thus, the manufacture of a mattress comprising a pad spring element according to WO 2004/086915 A1 is not only extremely complicate and expensive, but such a design is also not very flexible to handle and hardly accessible without destruction in case of repair works.

Based upon the above described state of the art, it is thus the object of the invention to propose a pad spring device that overcomes the above mentioned drawbacks and can be furthermore very flexibly used while being easily and cheaply manufactured.

For achieving this aim, the invention proposes a pad spring device, in particular for upholstered cushions, mattresses or the like, comprising a plurality of adjacent pad spring elements, wherein the pad spring elements are connected to each other by means of a flexible connecting means for forming a common unit.

The pad spring device according to the invention is characterized by its flexible connecting means. This flexible connecting means connects the individual pad spring elements of the pad spring device to form a common unit, wherein this unit is not rigid, i.e. fixed, but rather flexible. The thus formed pad spring device can be placed in a simple manner on very different bases and is suitable for both forming an under spring pad of a mattress, an upholstered cushion or the like and for forming an inner spring pad of a mattress, an upholstered cushion or the like.

The pad spring device according to the invention can be differently realized. In a first alternative embodiment of the invention, the pad spring devices can be connected to each other by means of a coupling unit to form a common unit, wherein the coupling unit is respectively situated in the area of the zero line of each pad spring element. In a second alternative embodiment of the invention, the pad spring elements can be placed in the pockets of a fabric or textile breadth which interconnects them for forming a common unit. These two embodiments of the invention shall be described in the following.

According to the first alternative embodiment, the invention proposes a pad spring device, in particular for upholstered cushions, mattresses or the like, comprising a plurality of adjacent pad spring elements, wherein each pad spring element is formed by a first spring part and a second spring part and wherein a coupling unit that connects the pad spring elements to each other for forming a common unit is positioned between the first and the second spring part of each pad spring element.

The pad spring device according to the invention is composed of a plurality of pad spring elements on the one hand and a coupling unit that connects the pad spring elements to each other for forming a common unit on the other hand. The individual pad spring elements can be fixed in a position-safe manner in their relative position to each other by means of this coupling unit. A relative displacement of the pad spring elements is not possible thanks to the coupling unit.

According to the invention, each pad spring element is composed of a first spring part and a second spring part. Herein, in the mounted state the first spring part is situated above the coupling unit and the second spring part is situated below the coupling unit. Thus, the coupling unit is placed between the first and second spring part of each pad element.

For connecting both spring parts, fasteners are used which are situated on the sides of the first and second spring part which are opposing in the mounted state of the pad spring element. Herein, the connection between the first and second spring part is preferably torsion-proof and detachable. For this purpose, the fastener can for example. have the form of a plug-in-connection. In order to prevent an undesired detachment of the spring parts, these ones and/or the fastener can have corresponding locking means. The realization of a clip connection is preferred.

Each one of the two spring parts has a spring body on the one hand and a supporting plate on the other hand. Herein, the spring body and the supporting plate are preferably integrally formed and made of plastic. The realization of the spring part as integral injection moulded part is preferred.

For simplifying the assembly, the first and the second spring part preferably have the same structural form. A mirror-inverted realization of the first and the second spring part is also imaginable, wherein in this case the spring parts have to be correspondingly marked for simplifying the assembly, in order to exclude confusions between the first and the second spring part.

The spring body is formed like a cone, i.e. it conically tapers from the supporting plate. Herein, the spring body comprises at least one helical spring arm. A two-branch realization, i.e. the provision of two spring arms, is preferred for preventing a non-uniform introduction of the forces.

The above described embodiment of the spring body has the advantage that this one can be compressed to quasi "zero". Thanks to the helical design of the spring arms and the altogether conical shape of the spring body, a very great range of spring in comparison to the vertical extension of the spring body is generated. In the completely compressed state the spring body presents an extension in the vertical direction which is essentially determined by the thickness of the supporting plate in the vertical direction. This construction permits to form small spring bodies, in particular with respect to the extension in the vertical direction, while simultaneously providing a relatively wide range of spring with respect to the vertical extension of the spring body. The pad spring device according to the invention is thus also suitable for forming relatively thin pad elements with respect to the vertical direction, such as for example seat-cushions, upholstered cushions for chairs or backs of chair seats, arm-chairs or the like.

The coupling unit that connects the individual pad spring elements to each other for forming a common unit has the form of a mat according to a special characteristic of the invention. It is for example imaginable to use a perforated film, a woven cloth material, a grid or network-like structure, a thermofilm or the like. As grid or network-like structure, a tissue composed of glass fibres comes for example into question. Also the use of cloth or of plastic or plastic-laminated mats is possible. It is only decisive that the coupling element that can be called a connecting mat allows a connection of the spring parts that form the pad spring elements on the one hand and allows a position-precise fixation of the pad spring elements with respect to each other on the other hand.

For connecting the pad spring elements to the coupling unit that connects them for forming a common unit, different connection techniques can be used. In a first embodiment it can be provided that the spring parts that form a pad spring element are locked with each other by means of corresponding insertion means. Thus, it can be for example provided that one spring part comprises a bore as well as a connection pin at one end. This connection pin of the one spring part engages in the bore of the opposite other spring part. This other spring part in turn also comprises a pin that engages in the bore of the first spring part. Spring parts that are connected to each other in this way are advantageously placed in a torsion-safe manner with respect to each other. Furthermore, such a connection proves to be stable and resistant against the forces acting upon the individual spring parts during an intended use of the pad spring device. In case of a connection of two spring parts for forming a pad spring element, the coupling unit that is advantageously formed like a woven cloth material is wedged in a position-safe manner between the two spring parts.

In another embodiment of the invention it is provided to sew the spring parts of a pad spring element with the coupling unit. According to this embodiment it is provided that each spring part comprises a recess, for example in the form of a bore, on the side of the coupling element, which recess serves for receiving sewing cotton. For realizing the pad spring device, a thread is passed through this recess which connects the two spring parts of a pad spring element to each other on the one hand and also safely fixes the coupling element positioned between these two spring parts on the spring parts. The connection technique of sewing thus enables both to connect the spring parts of a pad spring element to each other and to connect the interposed coupling element to the pad spring element, i.e. the two spring parts that form the pad spring element, in one manufacturing step. Each pad spring element is connected to the coupling element in this way.

The connection technique of sewing is principally suitable for coupling elements, i.e. coupling units that are made of a woven cloth material, a film or a grid or network-like structure. Herein, the advantage of sewing is in particular that an undesired detachment of the spring parts from the coupling unit is prevented. Furthermore, the production step of sewing can be carried out in a simple and in particular economic manner.

Thanks to the above described construction the pad spring device according to the invention can be widely used. Thus, it can serve as insert of pad elements, such as for example upholstered cushions, mattresses or the like, as it will be described in the following. Furthermore, it is possible to use the pad spring device according to the invention as base for seat-pads, mattresses or the like, both in the indoor and in the outdoor area. Application fields of the pad spring device according to the invention are any kinds of seating and resting furniture, such as for example chairs, in particular office chairs, resting furniture, in particular beds, outdoor furniture, in particular camping furniture, sleeper berths in camping cars, campers, ship cabins, truck cabins and the like. Thus, the application field of the pad spring device according to the invention is quasi unlimited. Herein, it is a special advantage that the pad spring device is not limited to special forms of the geometric design thereof. The geometric form of the coupling unit that carries the pad spring elements can be anyone and can for example have the form of a rectangle, a circle, a parallelogram or the like. It is also possible to provide the coupling unit with a geometrically individual shape, in order to adapt the pad spring device for example to the special circumstances of a sleeper berth in a ship cabin, a truck cabin, a camper, a camping car or the like. Thus, the coupling unit with pad spring elements mounted thereon can be provided as yard ware, which is cut by the user according to his individual desires. Thus, the pad spring device according to the invention can be very flexibly used and can fulfil individual wishes.

The invention further proposes a pad element, in particular an upholstered cushion, a mattress or the like, which is characterized by a pad spring device of the above described type.

The pad element preferably comprises a receiver that is at least partially made of foamed material for the pad spring device. This receiver is formed as a volume space into which the pad spring device can be inserted. In order to prevent a relative displacement between the pad spring device on the one hand and the receiver on the other hand, the pad spring device can be fixed with respect to the receiver according to another characteristic of the invention. This can be for example achieved in that the coupling unit that carries the pad spring elements is glued to the receiver. Other fixation ways are of course also possible, because it is only important to avoid an undesired relative displacement between the pad spring device, on the one hand, and the receiver, on the other hand, by connecting the coupling unit on the one hand and the receiver on the other hand.

The receiver of the pad element is preferably composed of a first and a second cover as well as of an interposed annular part. The volume space encompassed by the annular part then forms the receiver for the pad spring device. The first cover and the annular part are preferably at least partially made of foamed material. The second cover can also be made of foamed material. If the pad element is used as seat of a chair, for example an office chair, it will be however preferred that the second cover is composed of wood, plastic or the like. This second cover then forms a sort of base plate for the pad element in form of a seat shell. The foamed material that forms the first cover and the annular part is laid on this seat shell, wherein the pad spring device according to the invention is inserted in the receiver formed by the annular part of the foamed material. The thus formed pad element can then be provided with a cover, for example made of fabric, leather or the like.

A pad formed according to the above described manner presents an excellent resiliency thanks to the above described construction. The pad elements are quasi fatigue-free and thus non-ageing. They are corrosion resistant, which enables their use in the outdoor area. The pad elements further present a small thickness in the vertical direction, such that the pad element can be formed extremely flat.

According to another aspect of the invention, the annular part of the pad element consists of two pieces, wherein the side borders of the coupling unit are placed between the two pieces of the annular part. This kind of design has two substantial advantages. On the one hand, the coupling unit can be fixed in a very simple manner with respect to the annular part, which enables a simple and cost efficient manufacture. On the other hand, the volume space provided by the receiver for the pad spring device is divided into two mutually separate air chambers by means of the coupling unit, the side borders of which are connected to the annular part. The thus formed pad element has excellent heat insulation properties. This heat insulation effect can be furthermore supported in that an essentially air impervious thermofilm is used as coupling unit that divides the volume space of the receiver into two air chambers. This design is in particular advantageous for seat cushions in the outdoor area.

Furthermore, the invention proposes a bed, in particular a sick-bed and/or care bed which is characterized by a pad spring device of the above described type. In this embodiment the pad spring device according to the invention serves as base of a usual mattress. The pad spring device in turn leans on the lying surface provided by the bed, which lying surface can be for example formed by simple and non-resilient lying surface elements. Alternatively to the above described embodiment it can of course also be provided that the mattress used in connection with the bed is a pad element in the above described sense, i.e. it comprises a pad spring device of the type according to the invention as insert. Such a mattress can be directly laid on the lying surface provided by the bed, i.e. without any other support.

According to the second alternative embodiment; the invention proposes a pad spring device, in particular for upholstered cushions, mattresses or the like, comprising a woven cloth or textile breadth that forms receivers in form of pockets, wherein a pad spring element is placed inside each pocket.

The pad spring device according to the invention consists of a woven cloth or textile breadth on the one hand and several pad spring elements on the other hand. Herein, the woven cloth or textile breadth forms receivers in form of pockets, which respectively receive one pad spring element of the pad spring device according to the invention.

The positioning of the pad spring elements in the pockets of the woven cloth or textile breadth ensures that the pad spring elements are kept in a position-safe manner in their relative position to each other. An undesired displacement of the pad spring elements is thus prevented.

The woven cloth or textile breadth is preferably a double layer breadth and has a first upper layer and a second lower layer. For forming the woven cloth or textile breadth, the two layers are superposed, such that the first layer is the upper layer and the second layer is the lower layer. The two layers are connected to each other at some points, such that the pockets for receiving the pad spring elements are generated between the two layers. Herein, the pad spring elements can be glued at least at some points to both the first and the second layer, whereby an additional positional fixation of the pad spring elements is achieved.

For manufacturing the pad spring device according to the invention, at first the woven cloth or textile breadth is unrolled. The part of the woven cloth or textile breadth that forms the second lower layer in the finished state of the pad spring device is provided with the pad spring elements, which are preferably spaced from each other in lines or columns. An arrangement that differs from the disposition in lines or columns, for example a spiral disposition of the pad spring elements is of course also imaginable. As soon as the pad spring elements are placed in their desired orientation on the one part of the woven cloth or textile breadth, the other part of the woven cloth or textile breadth, which will form the first upper layer in the finished state of the pad spring device, will be turned over and laid on the other part of the woven cloth or textile breadth that is provided with the pad spring elements. In this way, a woven cloth or textile envelope is formed, wherein the pad spring elements are placed between the thus formed layers of the woven cloth or textile breadth. The superposed layers of the woven cloth or textile breadth are now connected to each other at certain points, i.e. in the regions between two juxtaposed pad spring elements. The pockets of the woven cloth or textile breadth are formed in this way, in which pockets the pad spring elements are situated.

Finally, the finished pad spring device is composed of a double-layer woven cloth or textile breadth, wherein the pockets for receiving the pad spring elements are formed between these two layers. The thus designed pad spring device is a sort of cloth mat with pad spring elements integrated therein.

According to an alternative embodiment of the invention, the woven cloth or textile breadth has one layer, wherein this one layer is connected to a support means in certain sections, which support means carries the pad spring elements. This support means can be for example formed like a seat shell and be made of wood, plastic, metal or the like. For forming such a pad spring device, at first the pad spring elements are positioned on the support means. For a simplified manufacture, the pad spring elements can be connected to the support means preferably by means of welding, gluing, riveting or the like. The thus prepared support means is then covered with a single-layer woven cloth or textile breadth. Herein, the woven cloth or textile breadth is connected to the support means at certain points in the interspaces of two adjacent pad spring elements. In this way, pockets are created which receive the pad spring elements.

The pad spring elements integrated in the woven cloth mat of the pad spring device are preferably composed of a base body on the one hand and a supporting plate integrally formed therewith on the other hand. As material of the pad spring element, in particular plastic comes into question, because this enables the integral realization of the pad spring element as injection moulded part.

The base body of the pad spring element preferably tapers from the supporting plate, like a cone. Herein, the base body comprises at least one helical spring arm. A two-branch realization, i.e. the provision of two spring arms, is preferred for preventing a non-uniform introduction of the forces.

The above described embodiment of the spring body has the advantage that this one can be compressed to quasi "zero". Thanks to the helical design of the spring arms and the altogether conical shape of the spring body, a very great range of spring in comparison to the vertical extension of the spring body is generated. In the completely compressed state the spring body presents an extension in the vertical direction which is essentially determined by the thickness of the supporting plate in the vertical direction. This construction permits to form small spring bodies, in particular with respect to the extension in the vertical direction, while simultaneously providing a relatively wide range of spring with respect to the vertical extension of the spring body. The pad spring device according to the invention is thus also suitable for forming relatively thin pad elements with respect to the vertical direction, such as for example seat-cushions, upholstered cushions for chairs or backs of chair seats, arm-chairs or the like.

According to an alternative embodiment of the invention, the pad spring element can also be composed of two spring parts, each of which is integrally formed, and which are connected to each other. For connecting both spring parts, fasteners are used which are situated on the sides of the first and second spring part which are opposing in the mounted state of the pad spring element. Herein, this connection between the first and second spring part is preferably torsion-proof and detachable. For this purpose, the fastener can for example have the form of a plug-in-connection. In order to prevent an undesired detachment of the spring parts, these ones and/or the fastener can have corresponding locking means. The realization of a clip connection is preferred.

Each one of the two spring parts is a pad spring element in itself and is preferably formed according to the above explanations according to a first alternative. Each one of the spring parts has a spring body on the one hand and a supporting plate on the other hand, wherein the spring body comprises at least one helical spring arm.

For simplifying the assembly, the first and the second spring part preferably have the same structural form. A mirror-inverted realization of the first and the second spring part is also imaginable, wherein in this case the spring parts have to be correspondingly marked for simplifying the assembly, in order to exclude confusions between the first and the second spring part.

According to another characteristic of the invention, the woven cloth or textile breadth is reinforced by glass fibres. Principally, all kinds of tissues or textiles are suitable for the woven cloth or textile breadth that are able to withstand the forces that occur during the intended use of the pad spring device according to the invention.

According to another characteristic of the invention, the woven cloth or textile breadth can be coated with a thermo-film. This realization is in particular advantageous, if the pad spring device shall be used for the outdoor area.

Thanks to the above described construction the pad spring device according to the invention can be widely used. Thus, it can for example serve as insert of pad elements, such as for example upholstered cushions, mattresses or the like, as it will be described in the following. Furthermore, it is possible to use the pad spring device according to the invention as base for seat-pads, mattresses or the like, both in the indoor and in the outdoor area. Application fields of the pad spring device according to the invention are any kinds of seating and resting furniture, such as for example chairs, in particular office chairs, resting furniture, in particular beds, outdoor furniture, in particular camping furniture, sleeper berths in camping cars, campers, ship cabins, truck cabins and the like. Thus, the application field of the pad spring device according to the invention is quasi unlimited. Herein, it is a special advantage that the pad spring device is not limited to special forms of the geometric design thereof. The geometric form of the woven cloth or textile breadth that combines the spring elements to a common mat-like construction can be anyone and can for example have the form of a rectangle, a circle, a parallelogram or the like. It is also possible to provide the woven cloth or textile breadth with a geometrically individual shape, in order to adapt the pad spring device for example to the special circumstances of a sleeper berth in a ship cabin, a truck cabin, a camper, a camping car or the like. Thus, the woven cloth or textile breadth can be provided as yard ware, which is precisely cut by the manufacturer according to the customer's desires. Thus, the pad spring device according to the invention can be very flexibly used and can fulfil individual wishes.

Furthermore, the invention proposes a pad element, in particular an upholstered cushion, a mattress or the like, which is characterized by a pad spring device of the above described type.

The pad element preferably comprises a receiver that is at least partially made of foamed material for the pad spring device. This receiver is formed as a volume space into which the pad spring device can be inserted. In order to prevent a relative displacement between the pad spring device on the one hand and the receiver on the other hand, the pad spring device is fixed with respect to the receiver according to another characteristic of the invention. This can be for example achieved in that the pad spring device is glued or otherwise connected to the foamed material that provides the receiver of the pad spring device. In a special embodiment of the invention, it can be provided in this context that the woven cloth or textile breadth comprises a bordering section that is fixed to the foamed material providing the receiver of the pad spring device for the fixation of the pad spring device.

The receiver of the pad element is preferably composed of a first and a second cover. Herein, the first cover is preferably made of a foamed material, whereas the second cover consists of a foamed material or a comparatively non-elastic material such as for example plastic, wood or metal. In an alternative embodiment of the invention it can be provided that an annular part is formed between the first cover and the second cover, which annular part itself is composed of two pieces, wherein the one piece of the annular part can be integrally placed on the first cover and the second piece of the annular part can be integrally placed on the second cover. In the finished state of the pad element, there is a gap between the two annular pieces of the covers, which gap can receive the border section of the woven cloth or textile breadth. This border section of the woven cloth or textile breadth can be fixed in the gap of the annular part by gluing. In this way, the pad spring device is fixed in a position-safe manner with respect to the foamed material of the pad spring element.

The pad element formed according to the above described manner presents an excellent resiliency thanks to the above described construction. The pad element is quasi fatigue-free and thus non-ageing. It is corrosion resistant, which enables its use in the outdoor area. The pad element further presents a small thickness in the vertical direction, such that the pad element can be formed extremely flat.

Furthermore, the invention proposes a bed, in particular a sick-bed and/or care bed which is characterized by a pad spring device of the above described type. In this embodiment the pad spring device according to the invention serves as base of a usual mattress. The pad spring device in turn leans on the lying surface provided by the bed, which lying surface can be for example formed by simple and non-resilient lying surface elements. Alternatively to the above described embodiment it can of course also be provided that the mattress used in connection with a bed is a pad element in the above described sense, i.e. it comprises a pad spring device of the type according to the invention as insert. Such a mattress can be directly, i.e. without any other support, laid on the lying surface provided by the bed, which itself is perhaps non-resilient.

Other characteristics and advantages of the invention will appear from the following description made with reference to the figures. Herein:

FIG. 2 is a perspective representation of a spring part;

FIG. 3 is a side view of a spring part;

FIG. 4 is a plan view from above of the spring part;

Figure 5:
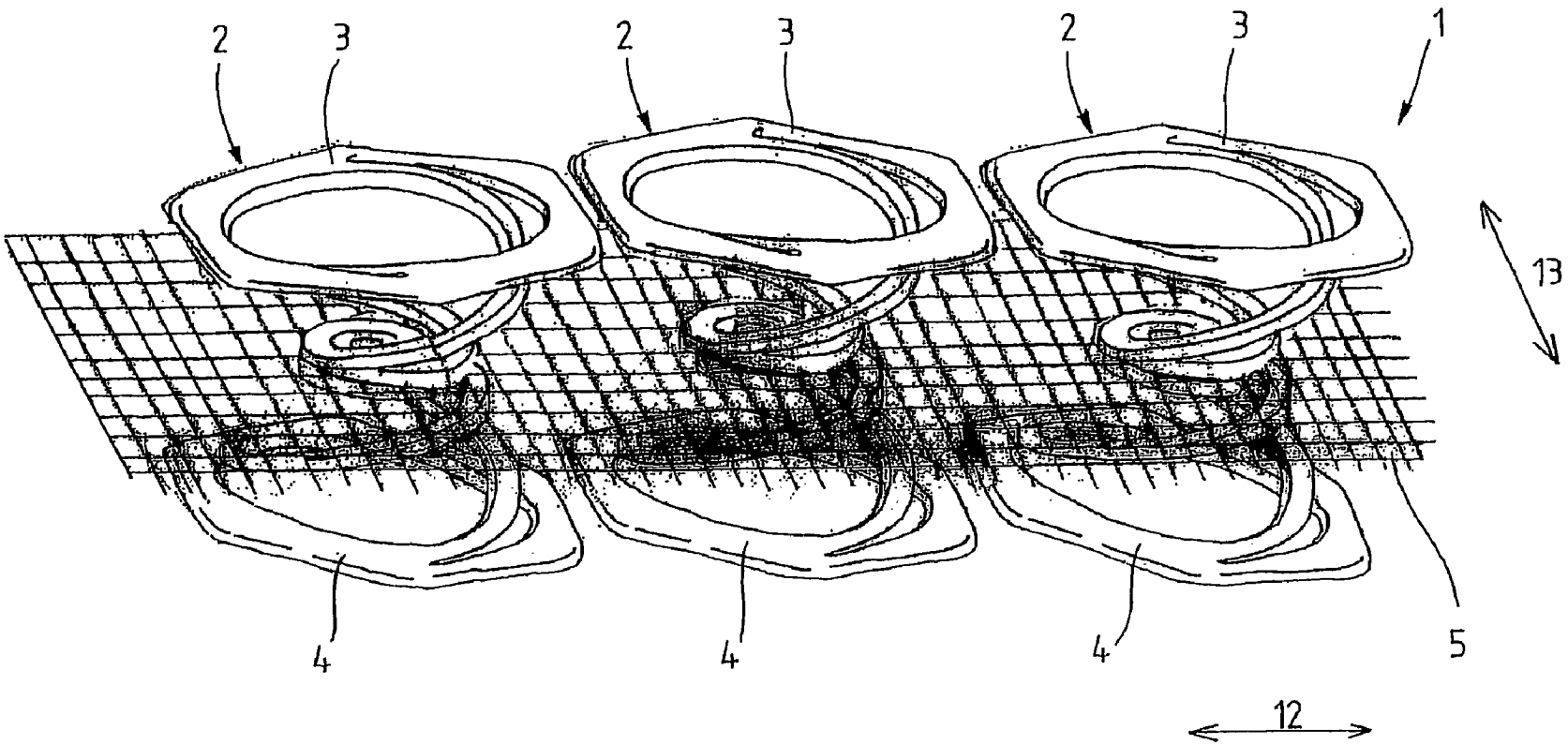
FIG. 5 is a perspective schematic view of a pad spring device according to the invention according to a first alternative.

FIG. 5 is a schematic perspective representation of a pad spring device 1 according to the invention according to a first alternative. The pad spring device 1 has a plurality of adjacent pad spring elements 2 which are connected to each other by means of a coupling unit 5 for forming a common unit. In the exemplary embodiment according to FIG. 5, three pad spring elements 2 in total are represented which are juxtaposed in the longitudinal direction 12. It is to be understood that the pad spring device 1 can have more than only three pad spring elements 2 which are then adjacent to each other both in the longitudinal direction 12 and in the transverse direction 13.

Each one of the pad elements 2 is composed of a first spring part 3 and a second spring part 4. In the representation of FIG. 5, the first spring part 3 is placed above the coupling unit, whereas the second spring part 4 is situated below the plane defined by the coupling unit 5.

The coupling unit 5 has the form of a mat and can be called connection mat thanks to its function to connect the individual pad spring elements 2 to each other for forming a common unit. As it is visible in FIG. 5, the coupling unit 5 is placed between the first spring part 3 and second spring part 4 of each pad spring element 2, i.e. the coupling unit 5 is situated on the zero line of each pad spring element 2. As materials of the coupling unit 5, in particular cloth tissues, synthetic tissues or glass fibre tissues come into question. Furthermore, the mat-like coupling unit 5 can be a grid or network-like structure and can be for example made of plastic or glass fibres. Such a realization is exemplarily represented in FIG. 1. The use of a perforated film is also imaginable. For the realization and the choice of material of the coupling unit it is only decisive that the coupling unit 5 enables a connection of two spring parts 3 or 4 for forming a pad spring element 2 on the one hand and allows a position-precise fixation of the pad spring elements 2 on the other hand, such that in the mounted state of the pad spring device 1 a relative displacement of the pad spring elements 2 is essentially prevented.

Figure 1:
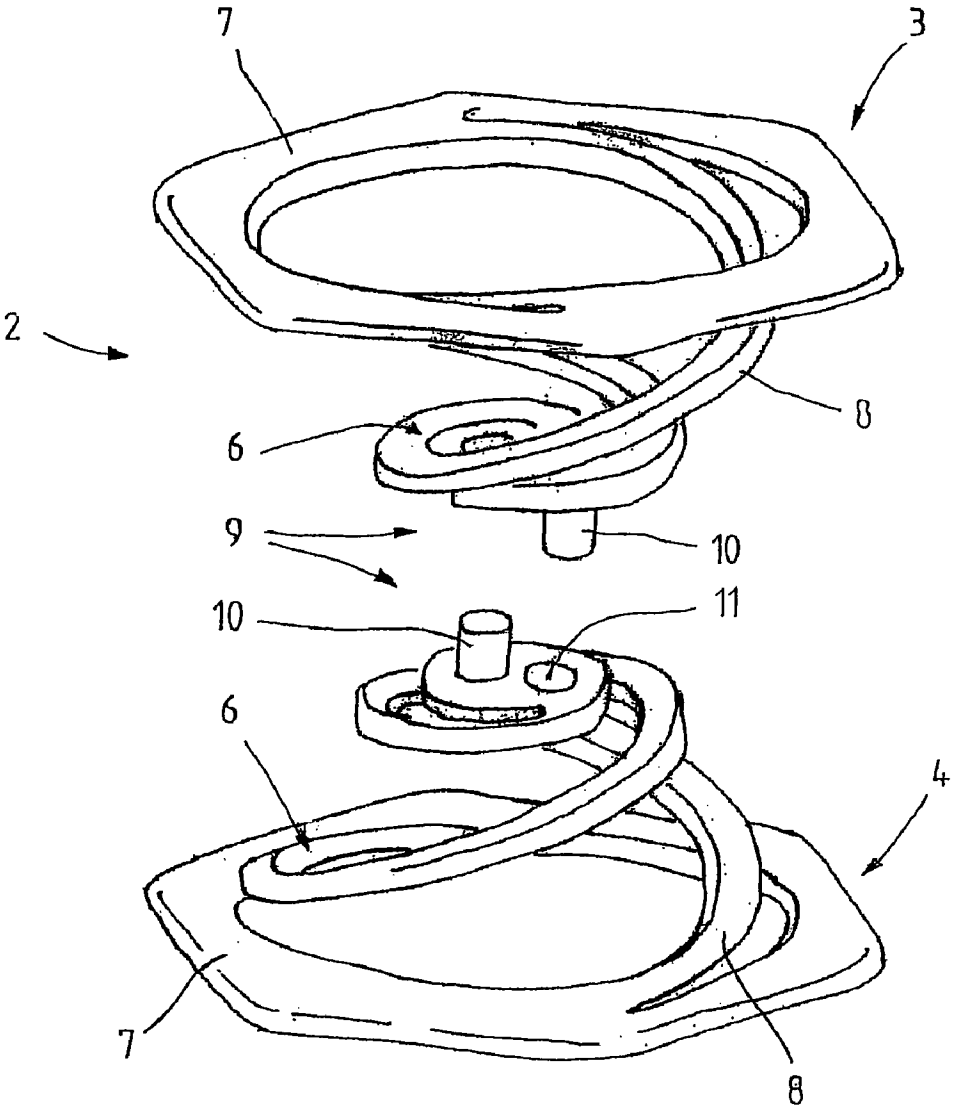
FIG. 1 is a schematic perspective view of a pad spring element according to the invention.

FIG. 1 is a schematic perspective representation of the detailed structure of a pad spring element 2. Here, one can see the first spring part 3 as well as the second spring part 4. These two spring parts 3 or 4 are connected to each other by means of the fastener 9. In the finished mounted state of the pad spring device 1 the coupling unit 5 is situated between the first spring part 3 and the second spring part 4, the coupling unit being not represented in FIG. 1 for a better clarity.

The fastener 9 is a pin assembly, wherein both the first spring part 3 and the second spring part 4 respectively carry a pin. Each pin 10 is respectively associated to a bore 11 in the opposite spring part, in which bore the respective pin engages in the mounted state of the pad spring element 2. In order to prevent an undesired detachment of the first spring part 3 and the second spring part 4, the fastener 9 can have corresponding locking means, which are not represented in FIG. 2 for a better clarity. Alternatively to this embodiment it is also possible that the spring parts 3 or 4, instead of the fastener 9, have corresponding locking means.

The above described fastener 9 is torsion-proof thanks to the arrangement of both a pin 10 on the first spring part 3 and a pin 10 on the second spring part 4. The fastener 9 is detachable, as represented in FIG. 2, which enables to separate the two spring parts 3 and 4 in case of need, for example for a dismounting operation or for repair works.

As it is visible in the simultaneous observation of FIGS. 1 and 5, the pins 10 of the spring parts 3 and 4 penetrate through the meshes or grid passages formed by the coupling unit 5 in the mounted state of the pad spring device 1. This realization assures that two spring parts that are connected to each other by interposition of the coupling unit 5 are placed in a position-safe and -precise manner on the coupling unit. A relative displacement of a pad spring element 2 composed of the two spring parts 3 and 4 is not possible, neither with respect to the coupling unit 5 nor with respect to the other pad spring elements 2 arranged on the coupling unit 5.

As it is visible in FIG. 1, both the first spring part 3 and the second spring part 4 are respectively composed of a spring body 6 and a supporting plate 7. The detailed structure is represented in FIGS. 2 through 4 by means of the first spring part 3.

As it is visible in the perspective representation of FIG. 2 and in the side view of FIG. 3, the first spring part 3 is composed of a spring body 6 on the one hand and a supporting plate 7 on the other hand. The spring part 3 is preferably an integral injection moulded part made of plastic. As it is in particular visible in FIG. 3, the spring body 6 is formed like a cone, wherein the spring body 6 tapers from the spring plate 7 towards below in the drawing plane.

The spring body 6 is formed by two spring arms 8, as it is in particular visible in the plan view of FIG. 4. The spring arms 8 are helical, such that in combination with the conical realization of the spring body 6, the spring part can be compressed to "zero". In the compressed state, the spring part therefore has an extension in the vertical direction that essentially corresponds to the thickness of the supporting plate 7. In comparison to the height of the spring part, this one thus has an extraordinarily great range of spring. In a preferred embodiment, the spring body 6 including the supporting plate 7 mounted thereon presents an extension in the vertical direction of 15 mm in the unstressed state. Depending on the application case, also other dimensions are of course imaginable.

As it is in particular visible in FIG. 3, the spring part 3 carries the already above described pin 10 on its side opposite the supporting plate 7, which pin allows the connection of spring part 3 with an associated second spring part 4. For the same reason, the first spring element 3 has a bore 11, as represented in FIG. 4, into which penetrates the pin of the second spring part 4, that is not represented in FIGS. 2 through 4, in the mounted state of the spring parts.

The second spring part 4 preferably has the same structural form as the first spring part 3 represented in FIGS. 2 through 4. A mirror-inverted realization of the two spring parts 3 and 4 is also imaginable, wherein in this case the two spring parts have to be correspondingly marked in order to prevent eventual defects in assembling.

The pad spring device 1 described by means of the above explained figures can be for example used as base for usual mattresses. Thus, one possible application is for example that the pad spring device 1 elastically supports a usual mattress, wherein the pad spring device 1 in turn is supported by a lying surface provided by a bed, wherein this lying surface does not have to provide further resilient properties and can be for example composed of simple lying surface elements made of plastic. Herein, as it is visible in FIG. 5, a coupling unit 5 is always situated between the two spring parts 3 and 4 of the pad spring elements 2 and is thus placed in the neutral plane between the spring parts 3 and 4. This is also visible in FIGS. 6 and 7 which shall be explained in the following.

Figure 6:
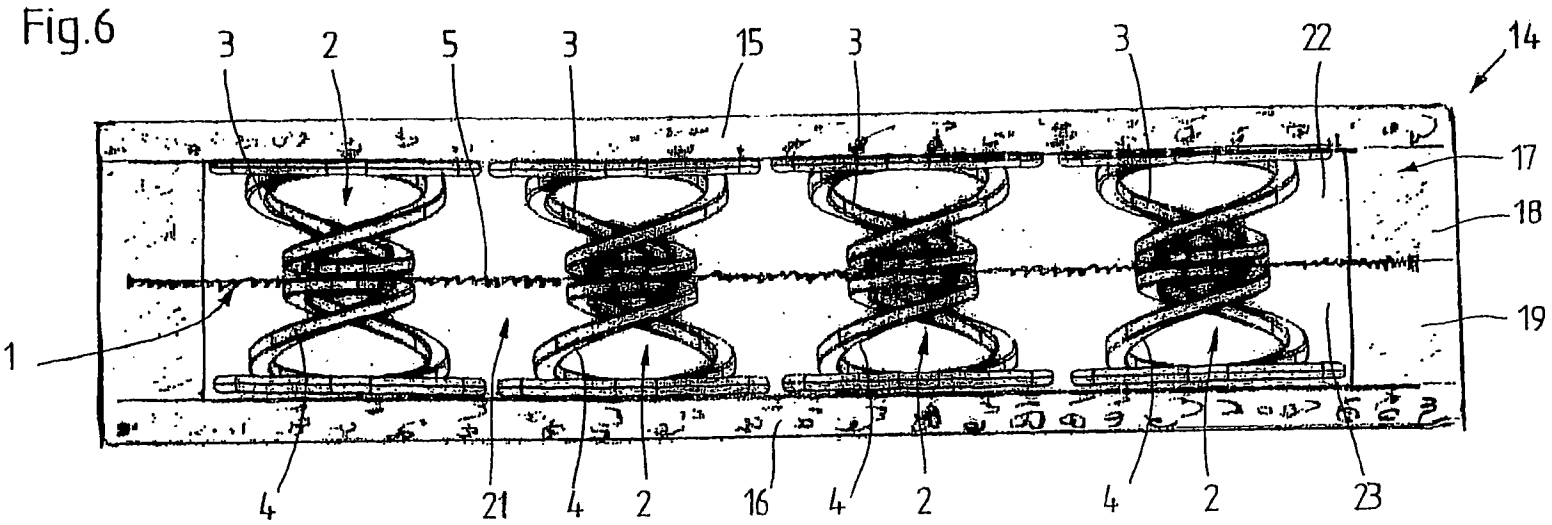
FIG. 6 is a partially cut side view of a pad element in form of a mattress according to a first alternative.

FIG. 6 is a partially cut side view that shows a pad element 14 in form of a mattress. This pad element 14 is characterized by the pad spring device 1 according to the invention.

The pad element 14 is formed by a first cover 15, a second cover 16 as well as an annular part 17. The first cover 15, the second cover 16 as well as the annular part 17 are respectively made of foamed material.

As it is visible in FIG. 6, the annular part 17 forms a receiver 21 that provides a volume space. This receiver 21 serves for the placement of the pad spring device 1, as represented in FIG. 6. The annular part 17 is composed of a first annular piece 18 and a second annular piece 19. The edge of the coupling unit 5 on the side of the annular part is arranged in a bordering manner between these two annular pieces 18 and 19, such that the coupling unit 5 and thus the entire pad spring device 1 is held between the two pieces of the annular part 17. For a better stabilisation, the coupling unit 5 can furthermore be glued on the side of the annular part to the annular pieces 18 and 19.

The above described construction ensures that the coupling unit 5 and thus the entire pad spring device 1 cannot be involuntarily displaced with respect to the mattress body, i.e. the covers 15 and 16 and the annular part 17. A position-safe fixation of the pad spring device 1 is thus ensured.

As it has already become clear from the above description, the geometric shape of the pad spring device can be principally chosen freely. This has consequently the advantage that also the pad element 14 can have any geometric shape. Thus it is for example imaginable to form the pad element that is shown in form of a mattress in FIG. 6 like a rectangle, a circle, an ellipse or otherwise. Herein, the imagination is not limited.

Figure 7:
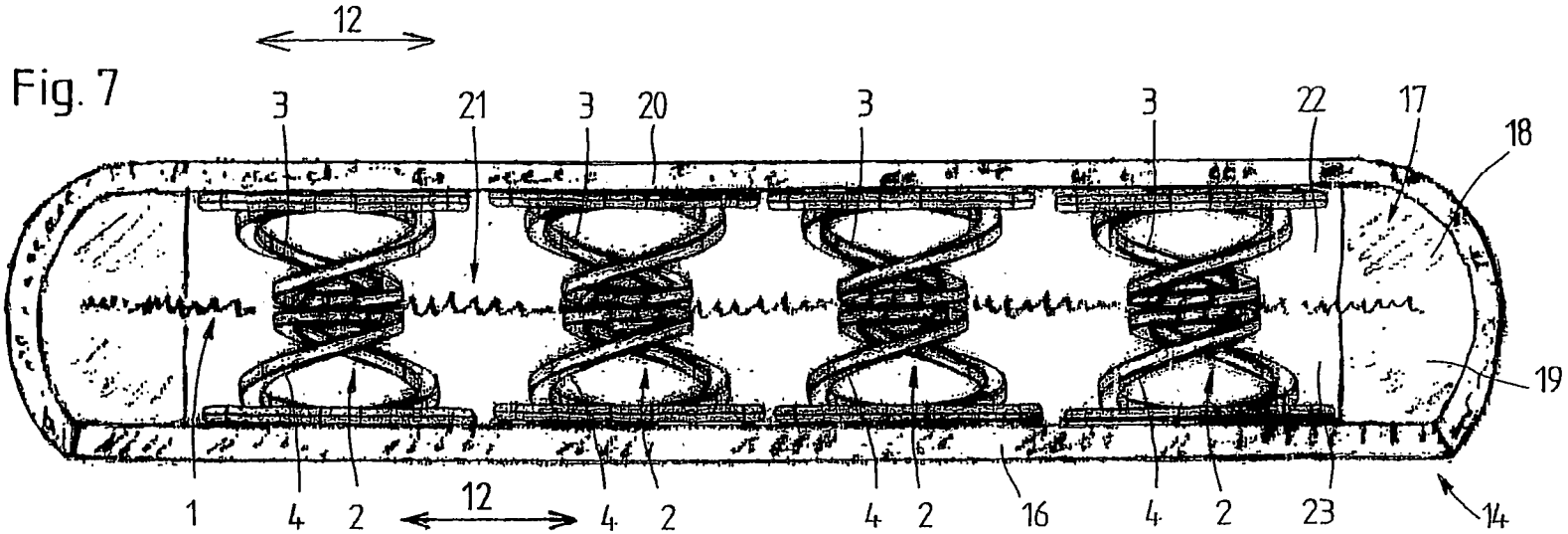
FIG. 7 is a partially cut side view of a pad element in form of a seat-cushion according to a first alternative.

FIG. 7 shows a pad element 14 in form of a seat-cushion or a pad for an office chair. According to the exemplary embodiment, the second cover 16 is formed like a seat shell and is for example made of plastic, wood or the like. A pad foam in form of an annular part 17 is laid on this seat shell. The annular part 17 serves for the stabilisation of the marginal area of the pad element 14 and is connected, for example glued to the second cover 16, i.e. the chair or seat shell. A pad spring device 1 according to the above-descriptions is inserted into the volume space provided by the annular part 17. The margin of the coupling unit 5 of the pad spring device 1 is embedded in the pad foam, i.e. the annular part 17. This can be for example achieved in that the annular part 17 has a correspondingly formed gap, into which the edge of the coupling unit 5 can be introduced. Alternatively to this embodiment it can also be provided that the annular part 17 is made of two pieces, as already described above with respect to FIG. 6, wherein the edge of the coupling unit 5 on the side of the annular part is placed between these two pieces 18 and 19 of the annular part 17.

In the plane of the sheet, a protective cover 20, for example a cloth cover, is placed above the pad spring device 1, which protective cover also encompasses the annular part 17 and extends towards the lower cover 16. The protective cover 20 and the lower cover 16 are preferably connected to each other, wherein usual connection types come into question.

As it is visible in FIGS. 6 and 7, due to the arrangement of the pad spring device 1 in the volume space provided by the annular part 17 this volume space is divided by the coupling unit 5 in so far as, seen in the plane of the sheet, a first air chamber 22 is created above the coupling unit 5 and a second air chamber 23 is created below the coupling unit 5. These air chambers offer the advantage of a special heat insulation of the seat, which is in particular useful if the pad element 14 is used in the outdoor area. This heat insulating effect can furthermore be supported in that the coupling unit 5 is formed by an essentially air-impermeable thermofilm.

Figure 8:
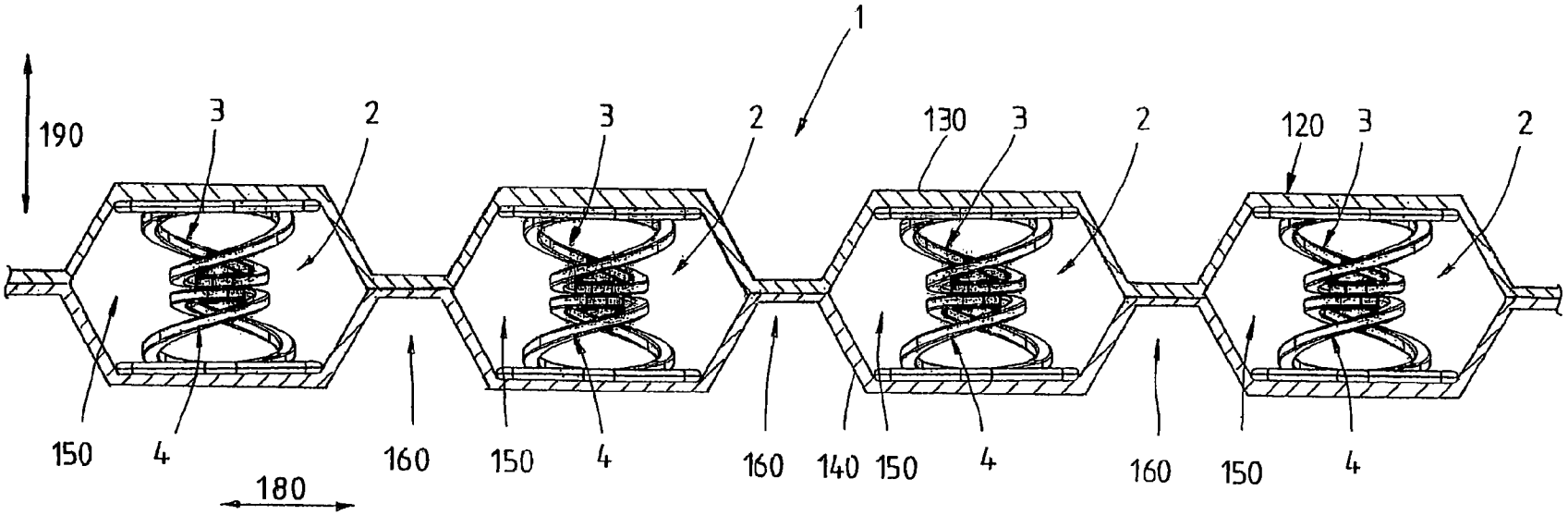
FIG. 8 is a partially cut side view of a first embodiment of the pad spring element according to the invention according to a second alternative.

FIG. 8 is a partially cut side view that shows a pad spring device 1 according to the invention according to a second alternative. The pad spring device 1 is composed of a plurality of adjacent pad spring elements 2. These pad spring elements 2 are encompassed by a woven cloth or textile breadth 120 in form of an envelope, which woven cloth or textile breadth 120 forms pockets 150, wherein each pocket 150 respectively receives one pad spring element 2.

According to the exemplary embodiment of FIG. 8, the woven cloth or textile breadth 120 is a double layer breadth and has a first upper layer 130 and a second lower layer 140. As it is clearly visible in FIG. 8, the two layers 130 and 140 are connected, for example welded, glued or sewed to each other in some sections of the connection areas 160 between two adjacent pad spring elements 2. These regionally, i.e. sectionwise connected layers 130 and 140 of the woven cloth or textile breadth 120 form the pockets 150 for receiving the pad spring elements 2.

As it is visible in the exemplary embodiment of FIG. 8, the pockets 150 that receive the pad spring elements 2 are juxtaposed in the longitudinal direction 180. Due to the elastic transition in the connection area 160 between two adjacent pockets 150, the pockets 150 can be pivoted with respect to each other, which permits to lay the pad spring device 1 also on a non flat base.

It is to be understood that the pad spring device 1 does not only present a geometric extension in the longitudinal direction 180, as represented in FIG. 8, but also extends in a direction that is perpendicular to the plane of the sheet according to FIG. 8. The pad spring device 1 thus is a textile mat, in which the pad spring elements 2 are integrated.

Figure 9:
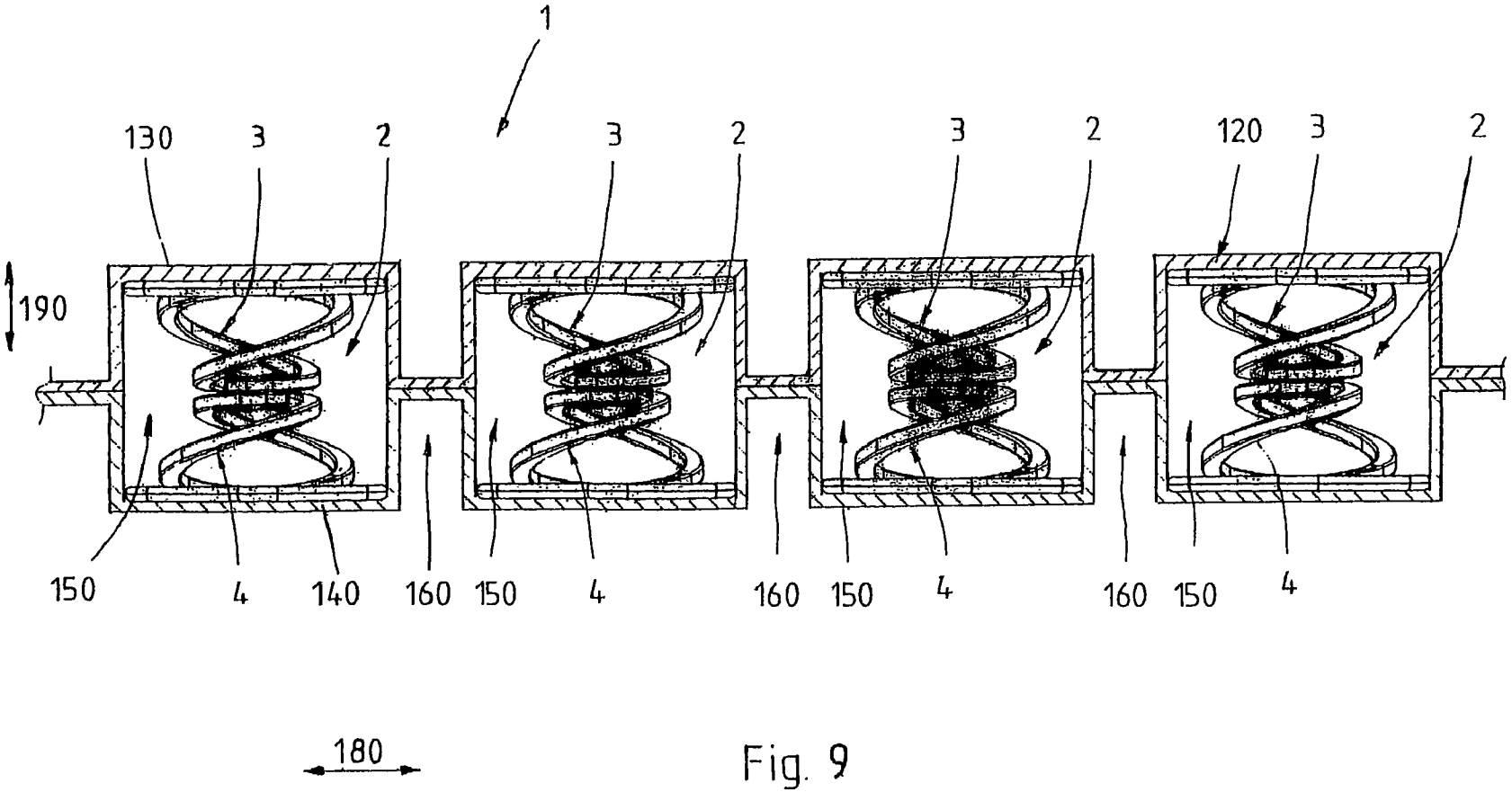
FIG. 9 is a partially cut side view of a second embodiment of the pad spring device according to the invention according to a second alternative.

An alternative exemplary embodiment is shown in FIG. 9. The structure of the pad spring device 1 according to FIG. 9 essentially corresponds to the structure of the pad spring device according to FIG. 8. The difference of the embodiment according to FIG. 9 in comparison to the embodiment according to FIG. 8 is that the pockets 150 that receive the pad spring elements 2 have a longitudinal section with rectangular contour, whereas the pockets 150 in the exemplary embodiment according to FIG. 8 present a longitudinal section with trapezoid contour.

It is to be understood that the pockets 150 can have any geometric shape, provided that they receive the pad spring elements 2 in a position-safe manner. Thus, the pockets 150 can also be annular cylinders and their shape can be adapted to the circular form of the spring elements.

Figure 10:
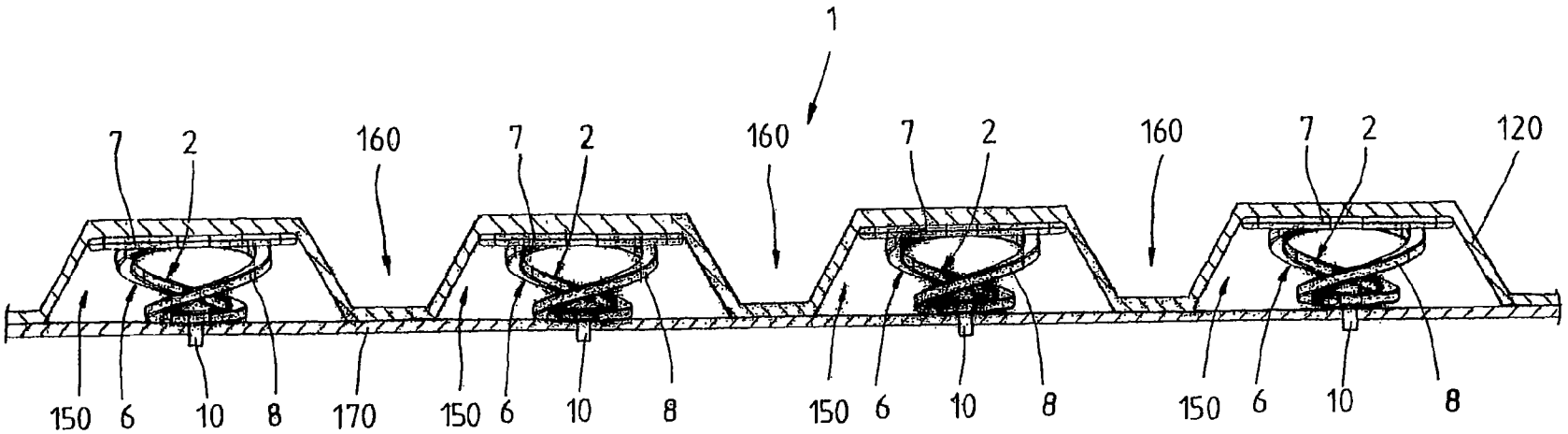
FIG. 10 is a partially cut side view of a third embodiment of the pad spring device according to the invention according to a second alternative.

A third exemplary embodiment is shown in FIG. 10. In this exemplary embodiment, the woven cloth or textile breadth 120 has one single layer which is a first upper layer 130. The layer 140 that is the second lower layer according to the exemplary embodiments of FIGS. 8 and 9 has been replaced in the exemplary embodiment of FIG. 10 by a support means 170 that can be for example a seat shell and can be made of wood, metal, plastic or the like.

According to a special embodiment, the pad spring elements 2 can have pins on their side facing the support means 170, which pins engage in corresponding bores of the support means 170. Thus, the pad spring elements 2 can be fixed in a position-safe manner on the support means 170. However, such a design is optional, since the pad spring elements 2 are already fixed in their position by the first upper layer 130 of the woven cloth or textile breadth 120 that is connected to certain sections of the connection areas 160.

As it is visible in FIG. 10, the pins 10 of the pad spring elements 2 have such a length that they project beyond the support means 170 on the side of the support means 170 opposite the pad spring elements 2. This design is in particular advantageous if the pad spring device 1 shall be fixed on a seat or lying surface. Then namely the protruding ends of the pins 10 can be used for such a fixation, such that additional fasteners are not required for mounting the support means 170 on a seat or lying surface. But such a design of the pins 10 is optional and not at all a condition for the intended use of the pad spring device 1 according to the invention.

As it is shown by the exemplary embodiments according to FIGS. 8 and 9 on the one hand and by the exemplary embodiment according to FIG. 10 on the other hand, the exemplary embodiments differ with respect to the used pad spring elements 2.

A pad spring element 2 used according to the exemplary embodiment of FIG. 10 is a so called first spring part 3 according to the FIGS. 2 through 4. The pad spring element 2 shown in the exemplary embodiments of FIGS. 8 and 9 is shown in FIG. 1. As already described above, this pad spring element 2 is composed of a first spring part 3 as well as of a second spring part 4. Herein, the spring parts 3 and 4 respectively correspond to a pad spring element 2 according to the exemplary embodiment of FIG. 10. The spring elements shown in FIGS. 1 through 4 can thus be used for both an embodiment of the invention according to a first alternative (FIGS. 5 through 7) and an embodiment of the invention according to a second alternative (FIGS. 8 through 12).

The pad spring device 1 described by means of the FIGS. 8 through 10 can be for example used as base for usual mattresses. Thus, one possible application is for example that the pad spring device 1 elastically supports a usual mattress, wherein the pad spring device 1 in turn is supported by a lying surface provided by a bed, wherein this lying surface does not have to provide further resilient properties and can be for example composed of simple lying surface elements made of plastic.

Figure 11:
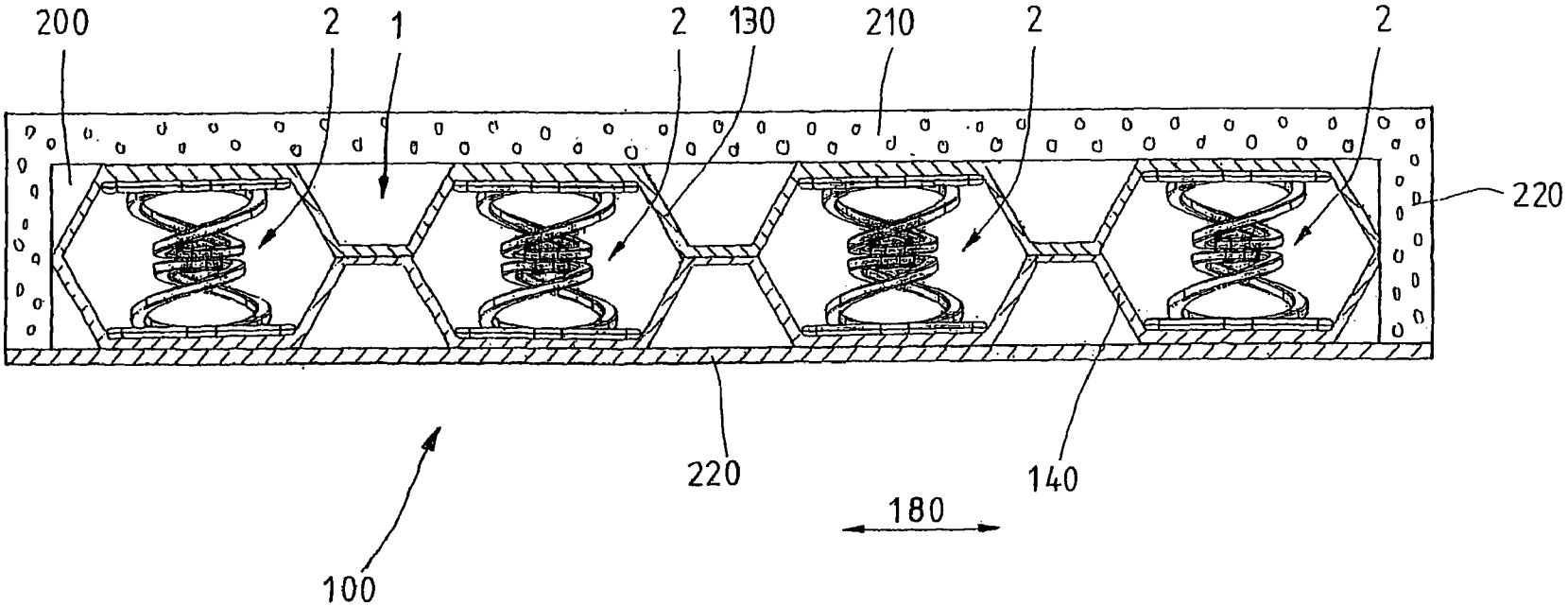
FIG. 11 is a partially cut side view of a first embodiment of a pad element according to the invention according to a second alternative and FIG. 12 is a partially cut side view of a second embodiment of a pad element according to the invention according to a second alternative.
Figure 12:
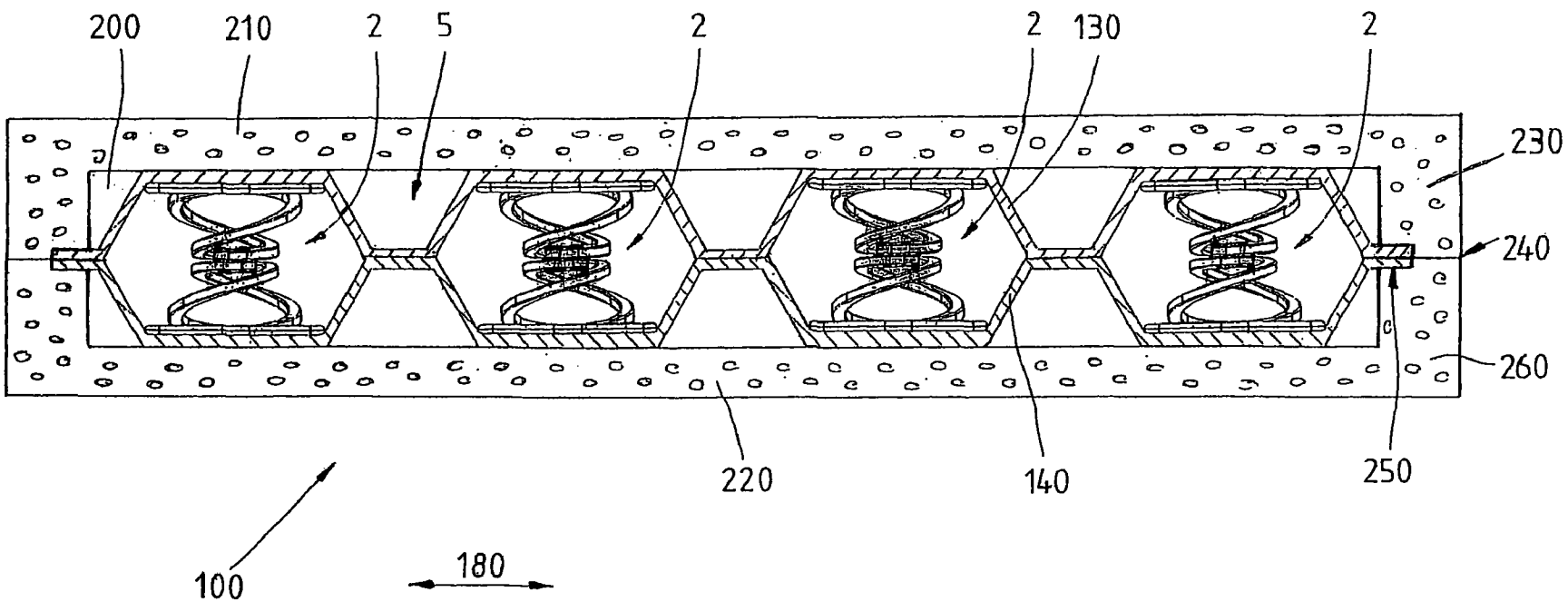

FIGS. 11 and 12 show an alternative use of the pad spring device 1 according to the invention. FIGS. 11 and 12 are each partially cut side views that show a pad element 100. This pad element 100 can be for example a mattress that is characterized by the pad spring device 1 according to the invention.

In a first embodiment shown in FIG. 11, the pad element 100 is composed of a first cover 210 and a second cover 220. The first cover 210 is preferably made of foamed material and has an annular part 230 integrally formed thereon. In the finished state the two covers 210 and 220 are superposed in the vertical direction 190 and form a receiver 200 in form of a volume space 200. The receiver 200 serves for receiving the pad spring device 1.

In the exemplary embodiment of FIG. 12, the pad element 100 consists of two covers 210 and 220 which are respectively made of foamed material. An annular piece 230 is integrally formed on the first cover 210, whereas the second cover 220 carries an annular piece 260 formed integrally thereon. In the finished state, the two covers 210 and 220 are superposed in the vertical direction 190, wherein a gap 240 is formed between the two annular pieces 230 and 260. The two covers 210 and 220 form a receiver 200 for the pad spring device 1 in an already above described manner. For the position-safe fixation of the pad spring device 1 with respect to the two covers 210 and 220, a marginal section 250 of the woven cloth or textile breadth 120 of the pad spring device 1 projects into the bordering gap 240 between the two annular pieces 230 and 260, where this marginal section 250 can be glued for an additional position fixation.

The invention claimed is:

1. A pad spring device for seat-cushions, upholstered cushions or mattresses, comprising:

a plurality of adjacent pad spring elements, wherein the pad spring elements are connected to each other by means of a flexible coupling unit for forming a common unit;

wherein each pad spring element being formed by a first spring part and a second spring part;

wherein a coupling unit that connects the pad spring elements to each other for forming a common unit is positioned between the first and the second spring part of each pad spring;

wherein both the first spring part and the second spring part includes a spring body and a supporting plate;

wherein said spring body and said supporting plate are formed integrally of plastic; and wherein the coupling unit is formed like a mat and wherein the pad spring elements are sewed to the coupling unit.

2. A pad element, in particular upholstered cushions, mattresses or the like, characterized by a pad spring device according to claim 1.

3. A pad element according to claim 2, wherein the receiver is formed by a first and a second cover as well as an interposed annular part.

4. A pad element according to claim 3, wherein the annular part is made of two pieces.

5. A pad element according to claim 4, wherein side borders of the coupling unit are placed between the two pieces of the annular part.

6. A pad spring element according to claim 5, wherein the first and second cover of the receiver and the annular part form an enclosure having an internal volume space;

wherein the coupling unit comprises a substantially air-impermeable thermofilm;

wherein said volume space includes a first air chamber formed on one side of the coupling unit between the coupling unit and the first cover and a separate second air chamber formed between an opposite side of the coupling unit and the second cover; and wherein one of said first and second spring parts is positioned in the first air chamber and the other of said first and second spring parts is positioned in the second air chamber.

7. A pad element according to claim 2, comprising a receiver that is preferably made at least partly of foamed material for the pad spring device.

8. A pad element according to claim 2, wherein the coupling unit of the pad spring device is fixed with respect to said receiver.

9. The pad spring device of claim 1, wherein the coupling unit is placed between the first and second spring parts such that one of the first and second spring parts is above the above the coupling unit and the other of the first and second spring parts is below the coupling unit and said supporting plates of the first and second spring parts are each in spaced relation to said coupling unit.

10. The pad spring device of claim 9, wherein the first and second spring parts each include a bore configured to receive a thread for sewing the first and second spring parts to the coupling unit.

11. The pad spring device of claim 9, wherein the first and second spring parts are sewn to each other and the coupling device.

12. A pad spring device according to claim 1, wherein the spring body conically tapers from the supporting plate.

13. A pad spring device according to claim 1, wherein the spring body at least comprises one helical spring arm.

14. A pad spring device according to claim 1, wherein the coupling unit is made of plastic or a plastic coated mat.

15. A bed, in particular a sick-bed and/or care bed, characterized by a pad spring device according to claim 1.

* * * * *